US006418673B1

(12) United States Patent
Flowerday

(10) Patent No.: US 6,418,673 B1
(45) Date of Patent: Jul. 16, 2002

(54) SYNETIC STRUCTURAL FORMS AND SYSTEMS COMPRISING SAME

(75) Inventor: Frederick G. Flowerday, Rodney, MI (US)

(73) Assignees: Steven J. Hultquist, Raliegh; Edward H. Greene, III, Cary, both of NC (US)

( * ) Notice: Subject to any disclaimer, the term of this patent is extended or adjusted under 35 U.S.C. 154(b) by 0 days.

(21) Appl. No.: 09/390,109

(22) Filed: Sep. 3, 1999

Related U.S. Application Data

(60) Provisional application No. 60/099,087, filed on Sep. 4, 1998.

(51) Int. Cl.[7] ..... E04B 7/08
(52) U.S. Cl. ..... 52/81.1
(58) Field of Search ..... 52/81.1, 81.2, 52/81.3, 81.4, 81.5, 720.1, 80.1

(56) References Cited

U.S. PATENT DOCUMENTS 1,662,554 A * 3/1928 Woeste ..... 52/81.4 X
3,533,202 A * 10/1970 Gellert ..... 52/80.1
3,841,039 A * 10/1974 Farnsworth, III ..... 52/81.1
4,555,878 A * 12/1985 Tringali ..... 52/81.1
4,825,602 A * 5/1989 Yacoe ..... 52/81.4
4,844,243 A * 7/1989 Stiles ..... 52/81.4 X
5,331,779 A * 7/1994 Hing ..... 52/81.1 X
5,394,661 A * 3/1995 Noble ..... 52/81.1 X
5,502,928 A * 4/1996 Terry ..... 52/80.1
5,505,025 A * 4/1996 Fleishman ..... 52/81.1
5,623,790 A * 4/1997 Lalvani ..... 52/81.4 X
5,660,003 A * 8/1997 Owens ..... 52/81.1

* cited by examiner

*Primary Examiner*—Jose V. Chen
(74) *Attorney, Agent, or Firm*—Yongzhi Yang; Marianne Fuierer; Steven J. Hultquist

(57) ABSTRACT

A strong, lightweight structural system wherein curved structural elements are tangentially joined. Compressive forces are distributed in a near continuous manner throughout the matrix, and tensile forces are present primarily to brace, support and pre-stress the compression net. The system is scalable from molecular through architectural levels, and finds many applications in dome shaped and spherical structures. The structural system also provides a force interaction model that is applicable to a broad array of real and theoretical problems.

8 Claims, 7 Drawing Sheets

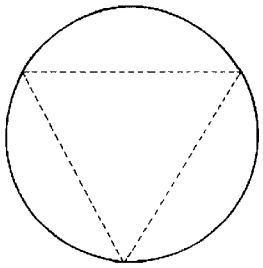
FIG. 1
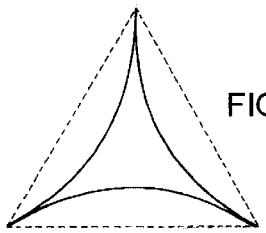
FIG. 2
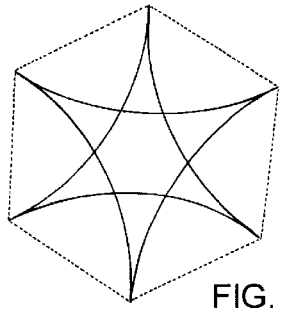
FIG. 3
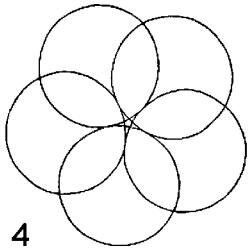
FIG. 4
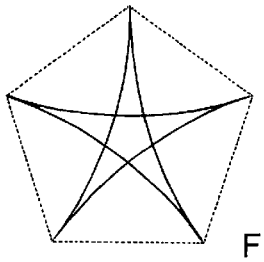
FIG. 5
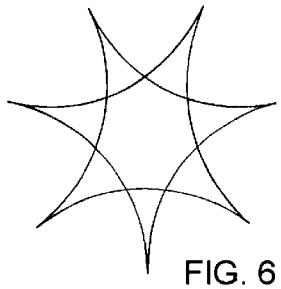
FIG. 6
FIG. 7
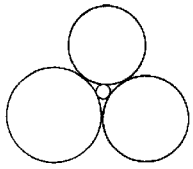
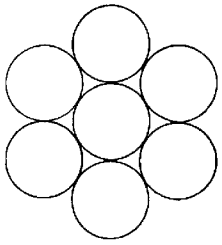
FIG. 8
FIG. 9
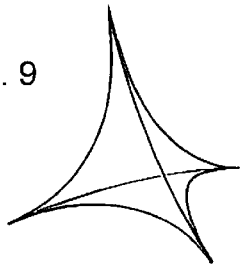
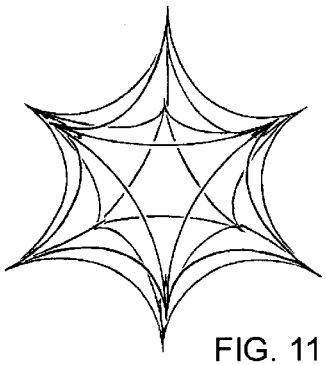
FIG. 11
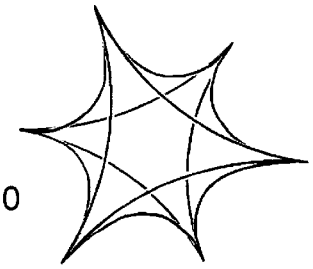
FIG. 10

SYNETIC STRUCTURAL FORMS AND SYSTEMS COMPRISING SAME

CROSS-REFERENCE TO RELATED APPLICATION

The priority of U.S. provisional patent application No. 60/099,087 filed Sep. 4, 1998 in the name of Frederick G. Flowerday is hereby claimed.

BACKGROUND OF THE INVENTION

1. Field of the Invention

The present invention generally relates to an improved structural system. More particularly, the present invention relates to a unique structural system that optimally balances compressive and tensile forces to produce strong, resilient structures using a minimum of material.

2. Brief Description of the Related Art

The first geodesic dome, a highly sub-divided icosahedron, with great circle arcs, was built in 1922 by Dr. Walter Bauersfeld. The structure was built on the roof of the Carl Zeiss optical works in Jena, Germany, and served as the first planetarium projector. The geodesic dome as a form of architecture was popularized by Richard Buckminster Fuller in the early 1950s. Fuller experimented with the interplay between compression and tensile forces in structures, and coined the term "tensegrity."

> The word 'tensegrity' is an invention: a contraction of 'tensional integrity.' Tensegrity describes a structural-relationship principle in which structural shape is guaranteed by the finitely closed, comprehensively continuous, tensional behaviors of the system and not by the discontinuous and exclusively local compressional member behaviors. Tensegrity provides the ability to yield increasingly without ultimately breaking or coming asunder.

Many types of structures are known in the art that employ the principles of geodesics and tensegrity. Matan et al., in U.S. Pat. No. 5,688,604, disclose a deformable, resilient tensegrity structure, wherein elastic tensile cords connect compression struts, with the tip of each strut being connected to the center of another.

Huegy, in U.S. Pat. No. 4,901,483, discloses a geodesic dome type tensegrity structure based on the helix formula and exhibiting features that enable easy construction.

Castro, in U.S. Pat. No. 5,857,294, discloses a dome roof support system of any arbitrary closed perimeter shape, wherein trusses are supported by a series of strategically placed vertebral compression members.

Several problems remain inherent in conventional structural design, most notably in geodesic and tensegrity design, which have stopped their usefulness as a system to model natural structuring, as well as limited their development as a widely deployed building system. These problems originated in early tensegrity theorizing with the insistence that compression be treated as linear, axial, chordal, discontinuous, and islanded in a 'sea of tension.'

Geodesic design axiomatically insists that compressive members be treated as linear and isolated, and that even a pneumatic structure such as a spherical manifold is optimally resolved into discrete patterns of tension and compression by a curved truss of sticks and knobs (struts and joints thereof). Limits to popular use of geodesics and tensegrities are soon apparent as increasingly large simple shapes require ever more complex, numerous, and consistently accurate components.

It is thus one object of the present invention to provide a structural system wherein compressive and tensile forces are optimally balanced in dynamic equilibrium.

It is a further goal of the present invention to provide a structurally independent building system, obviating the need for a foundation.

Yet another goal of the present invention is to provide a structure immune to catastrophic failure. The structures of the present invention can absorb dynamic loads that would flatten or fold traditional dome structures.

Still a further goal of the present invention is to provide a simple and inexpensive structure, lightweight and compact for storage and portage which is expandable and modular structure capable of being erected in a short time with a minimum of manpower, erection tools, or other facilities and structures.

A still further goal of the present invention is to provide a structural system wherein the delivery of utilities, such as heated/cooled air, water, electricity, data and information conduits, etc., is performed by integration of passageways for these utilities with the structural elements of the edifice.

Yet another goal of the present invention is to provide a structural/dynamic modeling framework, unlimited in application and scalable through all levels from quantum to universal.

SUMMARY OF THE INVENTION

The term SYNETIC is defined as the essential feature of a new building system where discrete patterns of compression optimally co-function with discrete patterns of tension to form structures in dynamic equilibrium. Synetic design utilizes minimal tensile and minimal compressive material. Synetic structures are pneumatic in behavior, the resolution of a manifold into optimally minimal and discrete co-functioning patterns of tension and compression. Energetic behaviors, deriving only from topology, and which operate at all scales, form and inform Synetic structure.

The present invention relates to a system of construction that utilizes the compressive properties of structural materials to the fullest advantage. In general, the invention is useful wherever it is advantageous to make the largest and strongest structure per pound of structural material employed. The invention relates to a structural system that may be employed in a wide variety of structures, including but not limited to domes, spheres, toroids and other pneumatic shapes useful as buildings. The invention also relates to a tension-compression modeling system used to teach and explore principles of dynamic forces that might apply to intangible and invisible structures.

The present invention relates to the discovery of a means and methodology to further reduce the aspect of compression in a structure so that, to a greater extent than has heretofore been possible, the structure will have the aspect of continuous compression throughout and the tension will be subjugated so that the tension elements become involved variously and as required to brace, support and pre-stress the compression net. In some embodiments tension functions are discontinuous, invisible, and the compressive aspects dominant throughout. One illustrative exercise helpful to understanding the present invention is to imagine taking the compressive force out of the single column or spar of a tent or tensegrity structure and, through the creation of a structure having continuous and finely divided compression, spreading the compressive function relatively evenly throughout the manifold.

The structure and operation of the present invention may be better understood by considering in turn the elements of Synetic structures: compression, tension, and attachment.

Synetic Compression

Synetic compression elements are curved, continuous, wavilinear and cyclical in nature. They are non great-circular and non-equatorial, i.e., they are non-geodesic, but they are everywhere ideally braced by geodesic tension. Conversely, Synetic compression, at all points, ideally braces geodesic tensile patterns.

In one embodiment of the present invention, compressive material is stiff, springy rod or tube (or bundles of rods or tubes) bent into arcs. Arcs are joined to form curved domical spans of a diameter many times that of an individual arc and very many times greater than the rod or bundle diameter. Frames use the minimum possible compressive material. Large structures have little air resistance and very little opacity.

Particularly important Synetic compressive elements are hoops of appropriate material, which have strong tendencies toward circularity, flatness, and a larger radius. Hoop-strength becomes sphere-strength.

Synetic Tension

Synetic tension is minimum, discontinuous, axial, chordal, straight, and geodesic.

Synetic frames are structurally independent of covering, and therefore may be wrapped, perhaps with material too weak to be used in conventional tents and domes. Being curvilinear throughout, they are particularly accommodating to thin material, fabric, nets and membranes. The structural independence of a Synetic frame allows covers to be made using simple gores and patterns relatively unrelated to the dome geometry. They support material that is too weak for conventional construction that may be layered, overlapped, wrapped. The radially expansive nature of Synetic frames allows such material to be maintained easily in uniform tension overall, providing smooth, structurally rational surfaces for further rigidifying. Uniform tension in the membrane diminishes flapping and mechanical degradation, reduces air resistance, sheds detritus, and pre-stresses the compression net. Although structurally independent, Synetic frames may be greatly strengthened by tensile attachment. Tensile bracing might be only a minimum required to maintain the balanced array of bows and accomplished by inter-linking arcs, or by tying or lashing of points of crossing or of tangency.

Further strengthening of a Synetic frame is derived from incremental addition of circumferentially comprehensive tension portions in the form of lines, nets, or fabric, until the frame is maximally braced in full membrane stress. The most efficient tensile patterns bracing Synetic structure will be geodesic.

Synetic Attachment

Synetic attachment is entirely by tangency, the universal cohesive principle of natural structuring. Tangent connection is thoroughly structurally integral, distributing dynamic loads throughout a Synetic structure with maximum efficiency. Synetic vertices are woven, turbined, and empty. Tangent connections are in pure thrust; they could comprise for example conventional compression fittings with continuous cable or strapping, or adhesive, welded or chemically bonded joints may be employed. Folding or collapsing of the structures may be accomplished by shortening or lengthening the compressive members in concert with corresponding adjustments to lengths of tensile material. Hinges or nodes might be included in compressive material to facilitate folding or erection of Synetic structures. Certain tension stays also might be easily demountable to aid folding and erection.

Synetic compressive elements are tangent to the whole, tangent locally to each other, join whole or partial structures, regular or irregular, globally or locally, larger to smaller, high frequency to low, one symmetry to another, planar to curved structure, concave to convex, angular to smooth, tension to compression, radial to tangential, rigid to flexible.

While Synetics shows integral waveforms, or curves of least work symmetrically impounded on a sphere, it also shows valency, potential connectivity that is symmetrically disposed by the same dynamic. Polygonal Synetic modular units and sub-assemblies are comprised of individual bowed arcs, paired arcs, or triangles of arcs, or modular units may be comprised of five-, six-, seven-, or eight-fold stars of incurved arcs, or they may be comprised of circles or other closed, cyclic patterns of arcs. The use of longer paths could allow certain constructions to be made of material directly from a coil by methods analogous to knitting. Polyhedral modular units are balanced symmetric arrays of inwardly curved arcs corresponding to the edges of tetrahedra, octahedra and icosahedra and consequently to all lattices, compounds and tesselations of them.

Synetic Models

Synetic design provides simple, self-similar, uniform structure, rendered in energetic, self-adjusting terms, well suited to symmetric development and polyhedral elaboration. Synetic flexibility allows open arrays, cages, and higher globally symmetric breakdowns or structure of negative curvature, all rendered in synergetic terms.

Synetics models the dynamics of structure in minimal terms of angle and energy.

At the quantum level of modeling, Synetics provide waveform, cyclic, integral curves of least work symmetrically impounded in open or closed systems.

At the atomic level, Synetic tangent articulation represents sites of valency, symmetrically disposed by balanced bowed arcs that are self-coordinating in structure of any complexity.

The energetics of atomic clusters may be realistically modeled without recourse to the numerology of close-packed spheres or cannonballs. Conventional ball-and-stick atomic modeling obscures the nature of attachment by positing spherical and cylindrical entities where only considerations of angle and frequency are appropriate.

While Synetics accommodates all regular lattices, its flexibility allows construction of open arrays, cages, zeolites, as well as structure with complex or negative curvature, toroids, helical tubes, etc. For example, Synetic tetrahedra model carbon structure, graphene sheets, triply periodic sponges, fullerenes, tubes, horns, helices and so forth. Similarly, it models tetrahedonal silicate elaborations.

On the scale of the architecture of life, Synetics models the tangent relations between fibers and membranes, fiber and fiber, conforming to minutely accretive structure as well as to branching, tree-like growth. Synetics also conforms to the interstitial architecture of minimal tension surfaces, relations between membrane and membrane, of cells, bubbles and foam.

DESCRIPTION OF THE DRAWINGS

FIG. 1 shows a hoop making possible the construction of a tensile triangle (dashed line), bracing it and being braced by it. Linear polygons are most efficiently derived as purely tensile constructs.

FIG. 2 shows a Synetic triangle of arcs maintaining a similar triangle of tensile potential but here the bows are internal to the triangle and are thus positioned to be braced in full membrane stress, extending internally and externally to the bows, and in the same plane.

FIG. 3 shows two overlapped Synetic triangles (curved, solid line) and potential paths of tensional strengthening (straight, dashed line, polygonal, geodesic patterns). Such tangent articulation allows six-fold articulation of Synetic members in flat or curved structure.

FIG. 4 shows Synetic five-fold articulation of hoops.

FIGS. 5 and 6 show five-and seven-fold articulation in Synetic modular 'stars,' employed to provide structures of compound or negative curvature.

FIGS. 7 and 8 show Synetic triangles as interstices of circle packings.

FIGS. 9, 10, 11, 12, 13, and 14 show Synetic tetrahedron, octahedron and icosahedron.

FIG. 37*a* shows twelve hoops each braced by others at five or six points of tangency. The hoop is a simpler, stronger, more fundamental structural unit than a triangle. Three times as simple.

DETAILED DESCRIPTION OF THE INVENTION, AND PREFERRED EMBODIMENTS THEREOF

Figure 13:
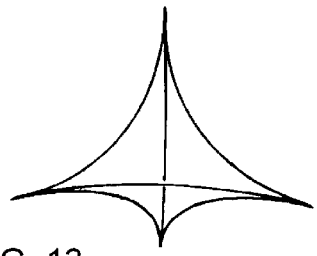
Figure 12:
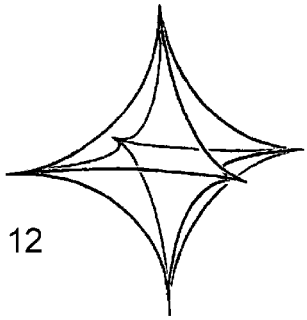
Figure 14:
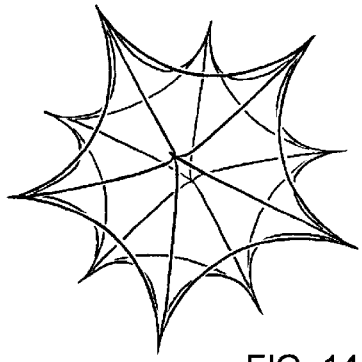
Figure 15:
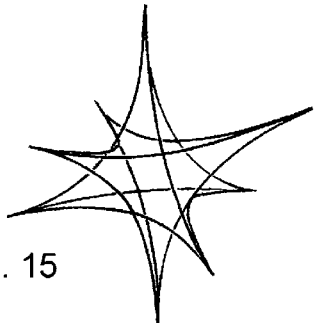
FIG. 15 shows two Synetic tetrahedra as a cubic compound.
Figure 17:
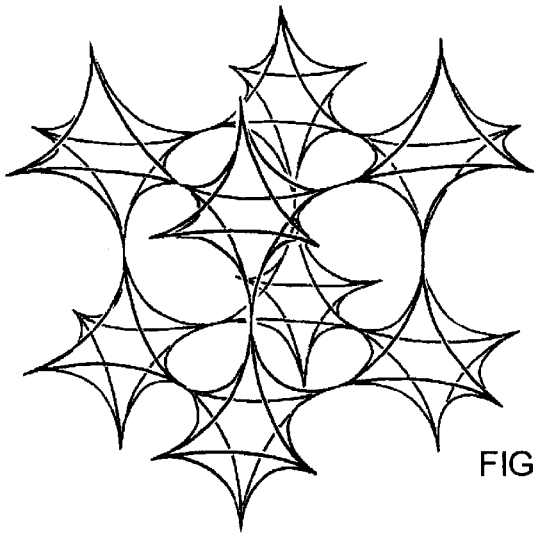
FIG. 17 shows a partial cubic lattice made of Synetic octahedra.
Figure 16:
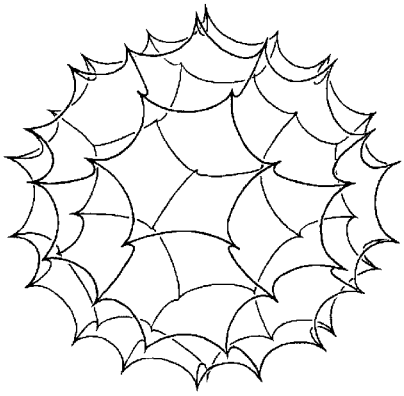
FIG. 16 shows balanced arcs conforming to a truncated icosahedron.
Figure 18:
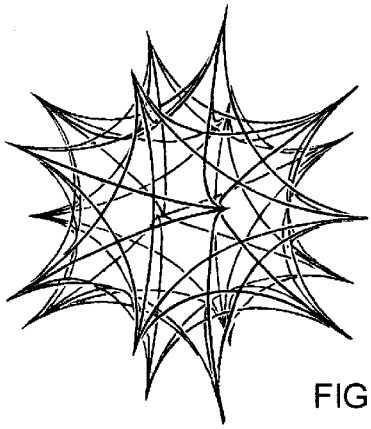
FIG. 18 shows a balanced array of sixty arcs conforming to the edges of five interpenetrating cubes inscribed in a pentagonal dodecahedron.
Figure 19:
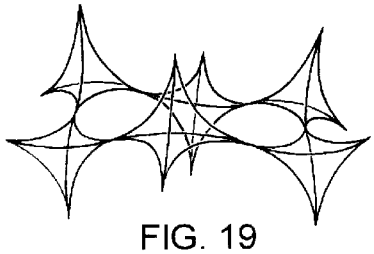
FIG. 19 shows six Synetic tetrahedra in the low energy configuration of a non-planar ring.
Figure 20:
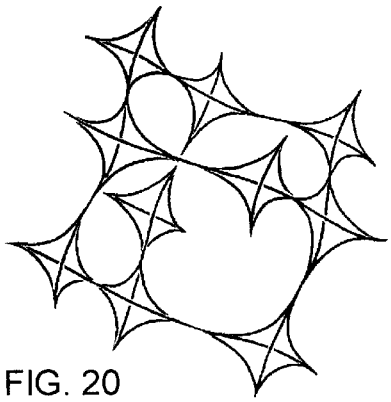
FIG. 20 shows ten Synetic tetrahedra in the low-energy configuration of a second-frequency, basic building unit of the diamond lattice.
Figure 21:
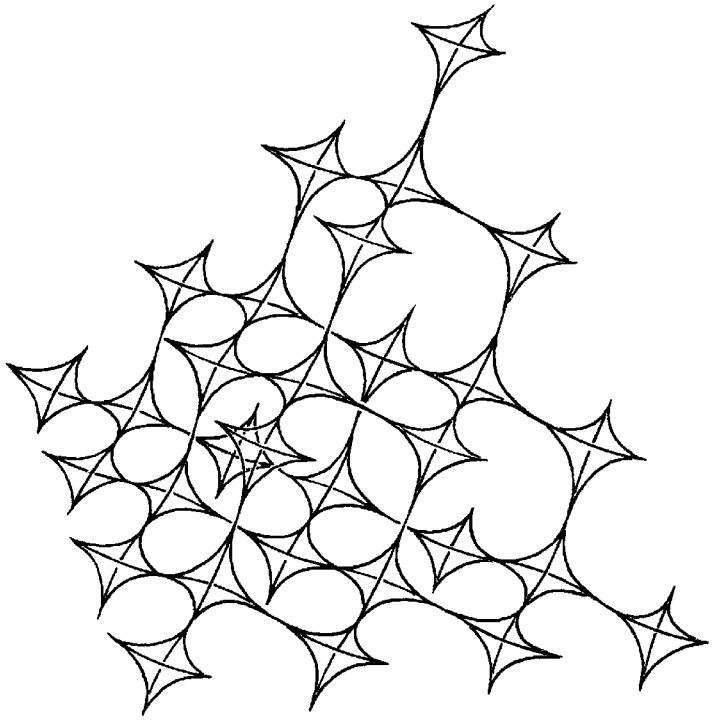
FIG. 21 shows a tetrahedonal segment of the Synetic diamond lattice, four Synetic units on an edge.
Figure 22:
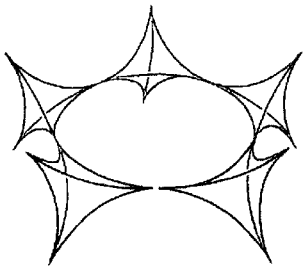
FIG. 22 shows a planar ring of five Synetic tetrahedra, a low-energy configuration that sets dihedral angles for further low-energy closure into a closed cage of twenty Synetic tetrahedra, shown in FIG. 23.
Figure 23:
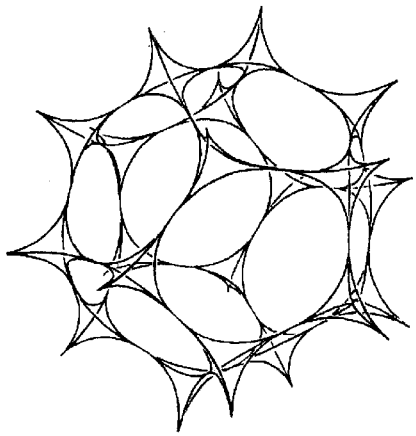
Figure 24:
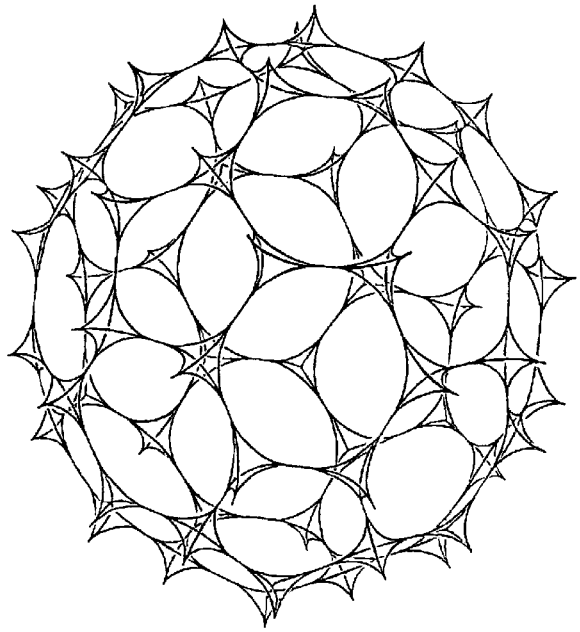
FIG. 24 shows a spherical cage comprised of sixty Synetic tetrahedra.
Figure 25:
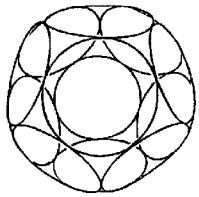
FIGS. 25, 26, 27, 28, 29, 30, 31, 32 shows examples of carbon structure rendered in Synetic terms.
Figure 26:
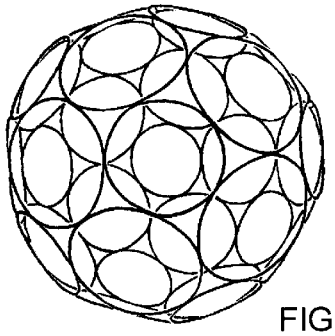
Figure 27:
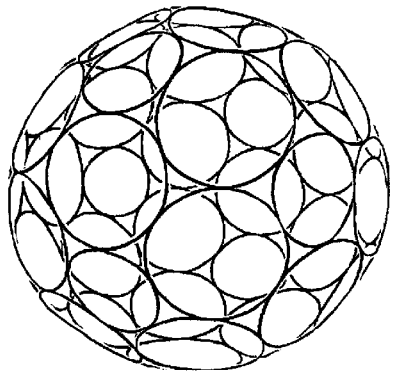
Figure 28:
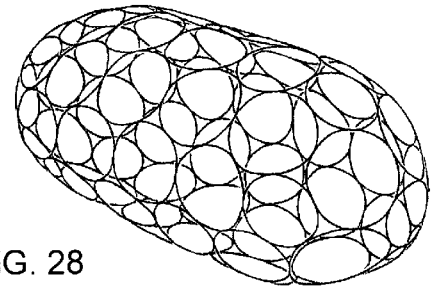
Figure 29:
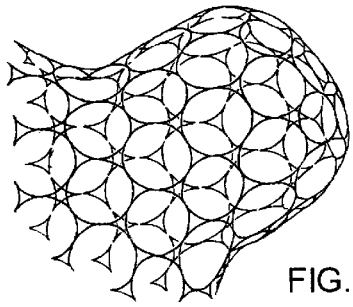
Figure 30:
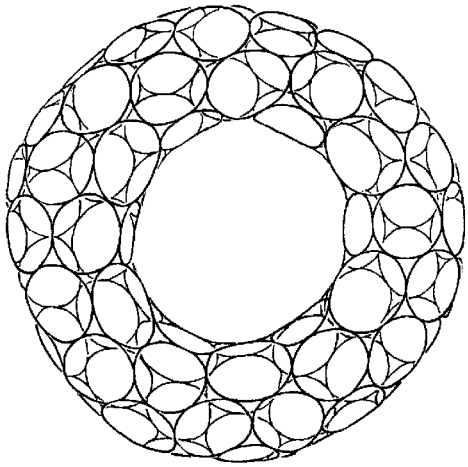
Figure 31:
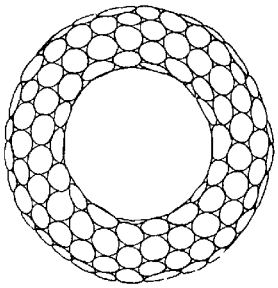
Figure 32:
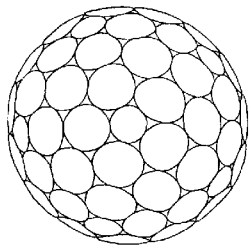
Figure 33:
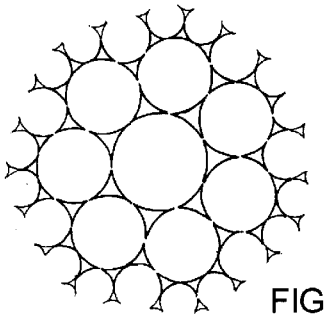
FIG. 33 shows seven-fold articulation of Synetic triangles that provide toroidal or saddle-shaped negative curvature.
Figure 34:
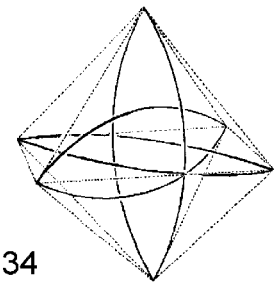
FIGS. 34, 35, 36 show a Synetic tension-compression equilibrium structure, octahedral in derivation, that, like other simple Synetic constructs, may be seen to be a node in an isotropic vector matrix, or as a vertexial domain in a two-dimensional manifold.
Figure 35:
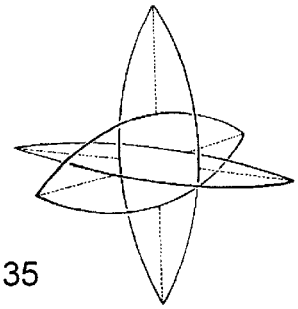
Figure 36:
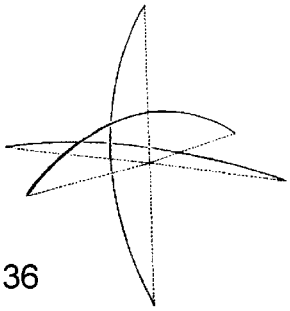
Figure 37:
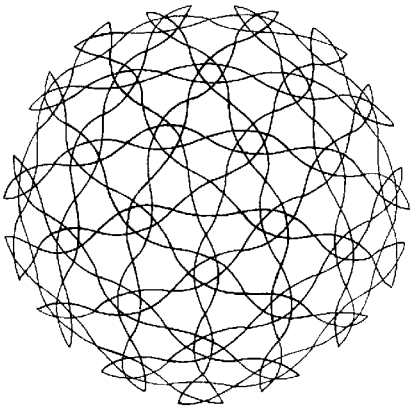
FIG. 37 shows the plan of a non-circular Synetic pattern forming a dome comprised of subunits resembling that shown in FIG. 35. Here also is displayed the Synetic conditions of curved, non-geodesic, continuous compression and straight, geodesic, discontinuous tension acting in dynamic co-function.
Figure 38:
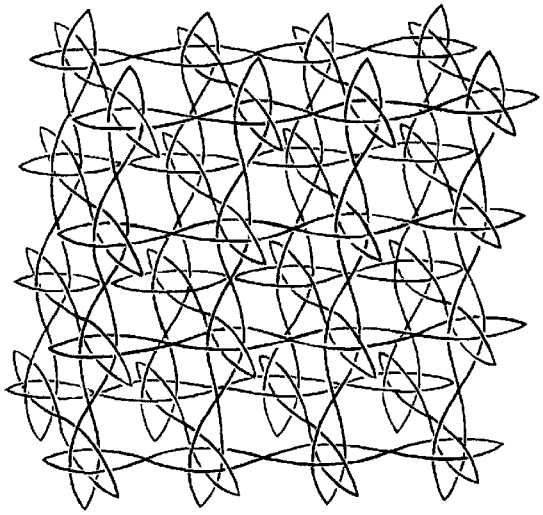
FIG. 38 shows such a Synetic isotropic vector matrix.
Figure 39:
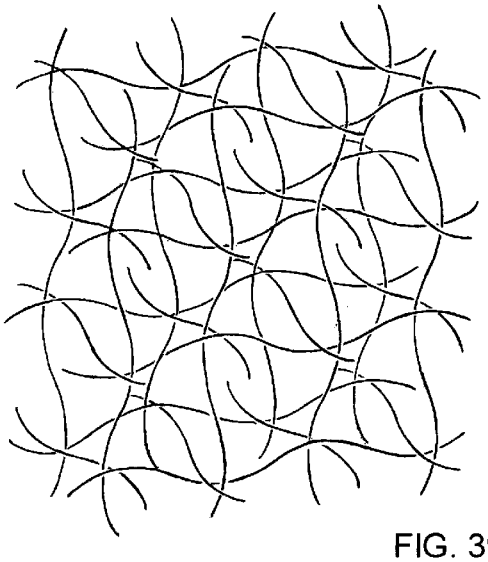
FIG. 39 shows the same matrix with redundant compressive material removed and tensile lines made continuous.
Figure 36A:
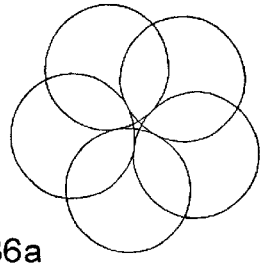
FIG. 36*a* shows Synetic articulation of five circular hoops, a non-planar structure.
Figure 37A:
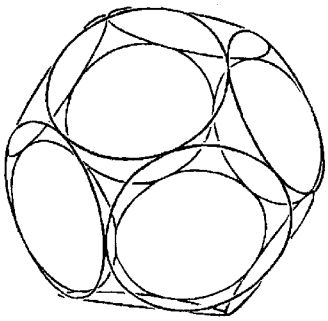
FIGS. 37*a* and 38*a,* though not drawn to scale, show two ways to place twelve equal circles on a sphere in tangency and with icosahedral symmetry. The Synetic dodecahedron in FIG. 37*a* illustrates how a polyhedron which, like the pentagonal dodecahedron or truncated icosahedron (FIG. 39*a*), which are conventionally considered to be inherently structurally unstable because of their lack of triangulation, are, in the Synetic system, fundamentally strong, low-energy configurations, as are Synetic tetrahedron and cube.
Figure 38A:
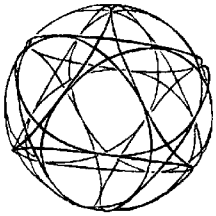
Figure 39A:
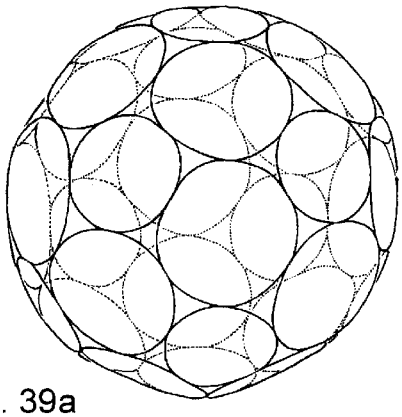
FIGS. 39*a* and 40, though not drawn to scale, show two ways to arrange thirty two circles of two sizes on a sphere in tangency and with icosahedral symmetry.
Figure 40:
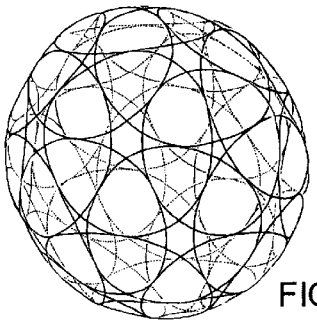
Figure 41:
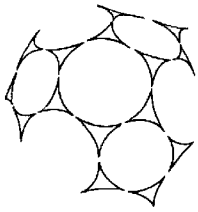
FIG. 41 indicates structural curvature arising from five- and six-fold articulation of Synetic Triangles.
Figure 42:
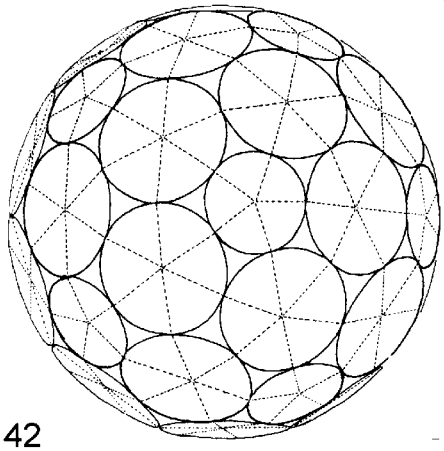
FIG. 42 shows a Synetic sphere of forty-two tangent compressive hoops (curved, solid line) of two sizes, braced by a geodesic tensile net (straight, dashed line).
Figure 43:
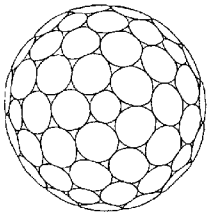
FIGS. 43, 44 show dome frame plans in higher frequency icosahedral Synetic pattern of tangent hoops.
Figure 44:
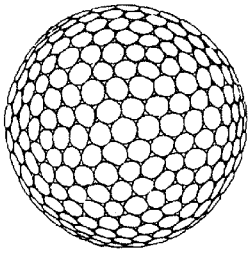
Figure 45:
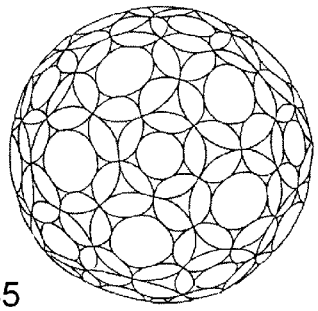
FIG. 45 shows a compound of Synetic tangent circle patterns overlapped.
Figure 46:
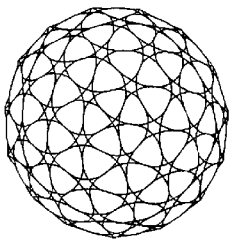
FIGS. 46 and 47 show dome plans using combinations of Synetic Star and Synetic triangle elements.
Figure 47:
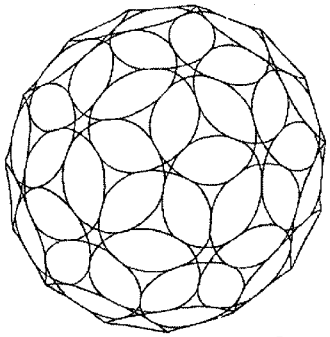
Figure 48:
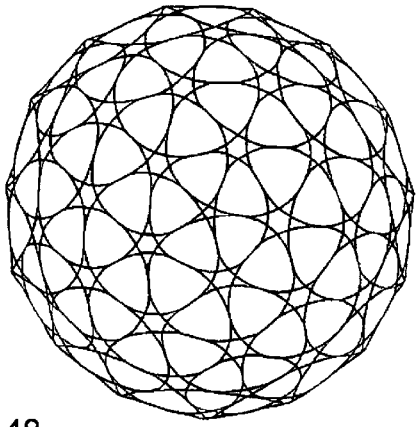
FIGS. 48 and 49 show dome plans of higher icosahedral frequency, comprised entirely of five- and six-fold Synetic Stars.
Figure 49:
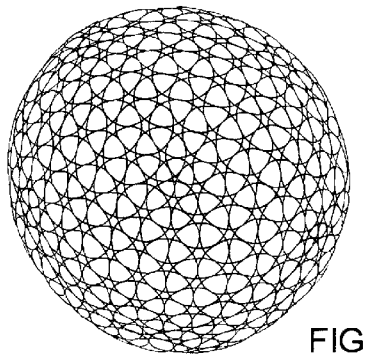
Figure 50:
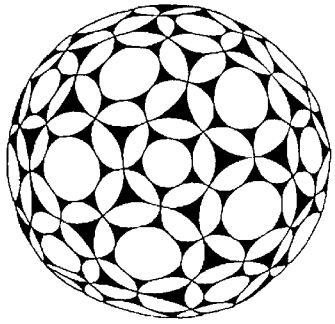
FIGS. 50, 51, and 52 show Synetic dome plans with certain portions infilled to indicate pattern differentiation which might be useful or decorative.
Figure 51:
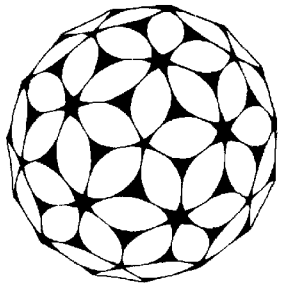
Figure 52:
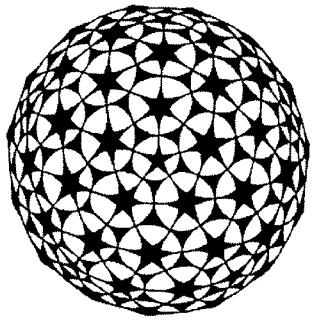
Figure 53:
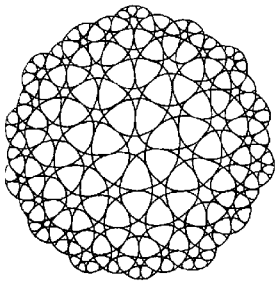
FIG. 53 shows a Synetic dome plan employing six- and seven-fold Stars (or circles),—a plan that has the advantage of providing more material, and more finely divided material, at the periphery and base of a dome where it might be needed most.
Figure 54:
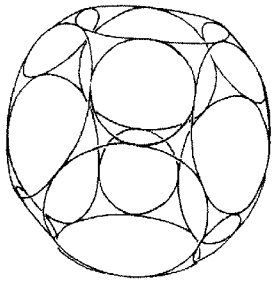
FIGS. 54 and 55 show octahedral patterning of Synetic tetrahedra, conforming to the interstitial architecture of the space-filling lattices of bubbles, cells and foam.
Figure 55:
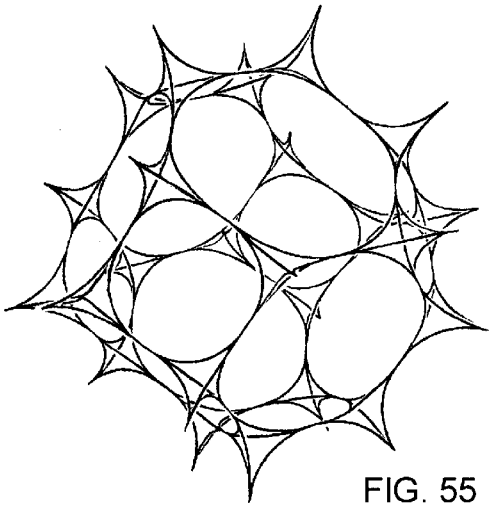

The present invention, while hereinafter primarily described in reference to architectural and engineering structures, is not thus limited, and may be applied to or embodied in a wide variety of other applications, some of which are illustratively described herein. None of these specific and illustrative examples however are to be taken as a limitation on the application of Synetic structures in the broad practice of the present invention.

Synetic Domes and Spheres

In one embodiment of the present invention, Synetic structures may be employed in a wide variety of architectural and engineering structural applications. At the domestic scale, a Synetic building is an airy and lace-like basketry of thin curvilinear material patterned in curvilinear triangulation. Bows of springy material are attached in tangency to one another in such a way that the tendency of arcs to spring radially outward is symmetrically restrained by the like tendency of other arcs. Spheres, domes, tubes and toroids behave as tough pneumatic membranes, bouncy and resilient even at large diameters. Synetic frames are exceptionally resilient and are capable of rebounding from extreme distortion. Gross form may be severely distorted without bringing individual members near to a radius of curvature at which they might fail. Synetic dome design is singularly effective in low-tech applications, being tolerant of distortion, inaccuracy, and inconsistency. Employing a minimum of compressive material, Synetic structuring makes good use of common but small and inconsistent material. For example, poor quality bamboo, of short length, finely split and bundled, is bowed into arcs and lashed to make large, high frequency domes. Other advantages appear in the extreme simplicity and low cost of Synetic construction, or in its modularity and potential for incremental strengthening, or in its ability to employ a wide variety of materials. Because of its flexibility, it has great capacity for combination, aggregation and truncation.

Bundling of divided material gives structural advantages to compressive material similar to that conferred on tensile material by fine division and networking. In another embodiment of the present invention, major structural elements could include thin-walled pneumatic tubes, of sufficient strength when inflated, to act as compression members in Synetic arrays. If bundled of arcs are employed to make a Synetic done, some arcs might serve a structural purpose while others function to deliver air, steam, water, electricity or gas.

Synetic domes are entirely curvilinear, yet readily conform to rectilinear or irregular intersections such as might be imposed by a rectangular floor plan or attachment to orthogonal buildings. Being structurally independent, Synetic domes do not require foundation, only tying down.

In construction, energy is added incrementally, compression-tension equilibrium being apparent and useful even in modular portions of the sphere. Buildings may be built upside-down then rolled over, no scaffolding required. At any stage of construction, Synetic frames are incapable of catastrophic failure. In many applications, the flexibility of structures can safely be increased to re-configure dynamic loads through a dome or cylindrical frame.

Conversely to their radially expansive nature, Synetic spheres present optimal compressive paths in response to external loading which acts to pre-stress and strengthen the structure.

In yet another embodiment of the present invention, a Synetic sphere or dome may be covered with impermeable membrane and centro-symmetrically loaded by atmospheric pressure as internal pressure is reduced by pumping or other means such as gross volumetric changes in the structure, valved control of heat-expanded air, osmosis, electrostatics, etc. Partial de-pressurizing of the structure further engages the covering as it is caused to cling to the frame, forming deep, radially inward curves between curved bights of the frame. These local curved membrane portions act as structural members to oppose arc deflection and buckling, to decrease membrane vibration and thus add stability and strength to the structure enabling it to carry heavy external loads. Relative de-pressurization will cause a spherical portion (dome) to be pressed strongly to the ground or water surface.

In still another embodiment of the present invention, a Synetic sphere or dome may be covered with a suitable membrane, providing a surface for the deposition thereon of traditional structural material, including concrete or a variety of foams and plastics, for the formation of a permanent, rigid edifice while retaining the strong Synetic structural undergirding.

In still another embodiment of the present invention, a Synetic sphere or dome may be advantageously employed in a variety of structures amenable to an open-air environment. Illustrative examples include sports stadiums, outdoor amphitheaters, or amusement park features, where a structure for the mounting of lights, audio/visual equipment, or advertising display is necessary, but weather imperviousness is neither necessary nor desired. The Synetic structures might find application as a trellis for the overgrowth of ivy or other plants to provide outdoor but quasi-covered dining at restaurants, or to cover a pool or spa area at a residence or resort.

In still another embodiment of the present invention, a Synetic sphere or dome may be advantageously employed to form structures which may optionally and temporarily be covered with a suitable material, or may remain uncovered and open, depending on the weather or other factors. Illustrative examples include greenhouses, tents, garages, animal cages, and similar applications.

Synetic Airship

In another embodiment of the present invention, Synetic structures may be employed as structural frames for airships. On the scale of airships, Synetic spheres are sufficiently lightweight and strong to be buoyant in air when appropriately covered and partially de-pressurized. Alternatively, the load imposed by a pressure differential may primarily serve to pre-stress and strengthen a framework to be strong and light enough to be lifted by other means of buoyancy. This provides for airship design a structural independence between the lifting body and the aerodynamic body, as well as other advantages deriving from strong, fly-able frameworks, for example to prevent catastrophic loss of drag in ruptured membranes, or to provide protected environments for the safe deployment of thin solar energy collectors or reflectors.

Accurately controlled dynamic effects in Synetic structure might further supply lift, control and propulsion to an airship.

Synetic Dynamics and Active Structures

Synetic resolution of a manifold into discrete patterns of compression makes possible accurate, electronically controlled local deformation of the structure, where adjustments to compressive elements are made co-functionally with those to tension elements. In still another embodiment of the present invention, connectors incorporating appropriate manifolds and pneumatic pistons, are deployed at points of tangent connection to extend or shorten Synetic compressive paths to produce strongly driven dynamic effects, or to provide active response to dynamic loading. Such "active" Synetic structures could, for example, counter the effects of strong wind forces or earthquakes "on the fly." Alternatively, or additionally, dynamic effects might include induced de-resonation of the structure, induced oscillation, or wave-form motions intended to drive air, or they may take the form of expanding or contracting volumetric portions in order to create accurately manageable pressure differentials.

Synetic Art and Toys

Synetic structures are curvilinear, sinuous, graceful, and evocative. They exhibit a naturally derived order and symmetry. In still another embodiment of the present invention, Synetic structures are deployed as sculptural works of art. As with all Synetic applications, the sculptures are scalable, illustratively spanning the range from tiny intricate spheres worn as jewelry, to desktop models, to large private and public sculptures. Synetic art may be combined with other media and environments. Integrated with the structural arcs of a Synetic sculpture may be a wide variety of lights and lighting technology; tubes carrying e.g. water for integration of the sculpture with a fountain or for the watering of plants integrated with the sculpture; apparatus for carrying and releasing smoke or scents; and/or a broad variety of other functions.

In still another embodiment of the present invention, a toy ball in the form of a Synetic framework is extremely light in weight, yet displays much resilience. The ball will bounce without much mass, and exhibits surface tension without much surface. Minimal in structure, without the drag of a balloon, it carries across the room if tossed or kicked. Due to its inherently open lattice surface, small children can grasp it easily, ball and concept.

While the present invention has been described herein with reference to specific features and illustrative embodiments, it will be recognized that the utility of the invention is not thus limited, but rather extends to and encompasses other features, modifications and alternative embodiments as will readily suggest themselves to those of ordinary skill in the art based on the disclosure and illustrative teachings herein. The claims that follow are therefore to be construed and interpreted as including all such features, modifications and alternative embodiments within their spirit and scope.

What is claimed is:

1. A structural assembly in the shape of at least a partial sphere, comprising a plurality of curvate structural members, wherein the shape of each curvate structural member is at least part of a circular arc, wherein each curvate structural member is tangently secured to at least one other curvate structural member, wherein each curvate structural member is formed of solid material, and wherein at least some of the curvate structural members comprise circular ring members.

2. A structural assembly, comprising:

a plurality of curvate structural members, each comprising at least part of a circular arc and each being tangently secured to at least one other curvate structural member, wherein each curvate structural member is formed of solid material, and force sensing means and computational means, wherein each curvate structural member is tangently secured to another via a displacement means under operative control of said computational means, whereby dynamic alterations in compressive and tensile forces induced in said assembly are sensed, and interconnection position of structural members of the assembly are responsively altered to achieve desired allocation of compressive and tensile forces throughout the assembly.

3. A structural assembly in the shape of at least a partial sphere, comprising a plurality of curvate structural members, wherein the shape of each curvate structural member is at least part of a circular arc, wherein each curvate structural member is tangently secured to at least one other curvate structural member, wherein each curvate structural member is formed of solid material, and wherein the curvate structural members are tubular members.

4. A structural assembly in the shape of at least a partial sphere, comprising a plurality of curvate structural members, wherein the shape of each curvate structural member is at least part of a circular arc, wherein each curvate structural member is tangently secured to at least one other curvate structural member, wherein each curvate structural member is formed of solid material, and wherein the curvate structural members are solid rod members.

5. The structural assembly of claim 2, wherein the curvate structural members are tubular members.

6. The structural assembly of claim 2, wherein the curvate structural members are solid rod members.

7. A structural assembly, comprising a plurality of curvate structural members, wherein the shape of each curvate structural member is at least part of a circular arc and each curvate structural member is tangently secured to at least one other curvate structural member, and where each curvate structural member is either a tubular member or a solid rod member.

8. A structural assembly, comprising a plurality of curvate structural members, wherein the shape of each curvate structural member is at least part of a circular arc and each curvate structural member is tangently secured to at least one other curvate structural member, wherein each curvate structural member is formed of compressible solid material and selected from a group consisting of: stiff arcuate tubular members; springy arcuate tubular members; stiff elongated arcuated members; springy elongated arcuate members; and solid rod members, and wherein at least some of the curvate structural members comprise circular ring members.

* * * * *